US005165554A

United States Patent [19]

Schlesinger

[11] Patent Number: 5,165,554

[45] Date of Patent: Nov. 24, 1992

[54] STORAGE RACKS

[76] Inventor: Peter R. Schlesinger, 8 Puna Street, Orakei, Auckland, New Zealand

[21] Appl. No.: 592,918

[22] Filed: Oct. 4, 1990

[30] Foreign Application Priority Data

Oct. 4, 1989 [NZ] New Zealand ..... 230890
Jul. 23, 1990 [NZ] New Zealand ..... 234611

[51] Int. Cl.[5] ..... A47F 7/00
[52] U.S. Cl. ..... 211/51; 211/88
[58] Field of Search ..... 211/50, 51, 88, 184; 248/444.1

[56] References Cited

U.S. PATENT DOCUMENTS

| | | | |
|---|---|---|---|
| 458,595 | 9/1891 | Rokusek | 211/51 |
| 769,375 | 9/1904 | Cain | 211/51 X |
| 774,495 | 11/1904 | Richard | 211/50 |
| 1,560,493 | 11/1925 | Steinberg | 211/50 |
| 2,268,025 | 12/1941 | Erikson | 211/184 X |
| 2,927,699 | 3/1960 | McGraw | 211/51 |
| 3,216,582 | 11/1965 | Cross | 211/50 |
| 4,003,470 | 1/1977 | Lagorio et al. | 211/50 |
| 4,460,095 | 7/1984 | Kessler et al. | 211/50 X |
| 4,630,731 | 12/1986 | Albery | 211/50 X |
| 4,901,912 | 2/1990 | Pinard | 211/88 X |

FOREIGN PATENT DOCUMENTS

| | | | |
|---|---|---|---|
| 1146319 | 4/1902 | France | 211/51 |

*Primary Examiner*—Ramon O. Ramirez
*Assistant Examiner*—Sarah A. Lechok
*Attorney, Agent, or Firm*—Jacobson, Price, Holman & Stern

[57] ABSTRACT

A storage rack is provided particularly suitable for the storage and display of papers and pamphlets. The rack has spaced front and rear walls and biasing means to bias a stack of papers or pamphlets within the rack against the inner surface of the front wall. The rack is preferably fabricated from transparent plastics sheet and may be provided with a sleeve on the outer surface of the front wall in which a display copy of the paper or pamphlet is retained.

7 Claims, 5 Drawing Sheets

STORAGE RACKS

FIELD OF THE INVENTION

This invention relates to storage racks and/or a method of making the same and has been devised, in particular, to provide a storage rack for pamphlets, brochures, papers or the like.

BACKGROUND OF THE INVENTION

It is common to store papers, pamphlets or the like in substantially vertical storage racks from which they can be withdrawn as required. Typically these racks comprise vertically oriented pockets into which the papers, pamphlets or like are placed and from which they can be withdrawn as required.

Racks of this general type have a number of disadvantages. Typically racks of the known type present the pamphlet or paper closest to the front wall of the rack as the most convenient for withdrawal. Depending on the nature of the pamphlet or paper, the quality of material on which it is printed, and the extent to which the rack is full, a somewhat awkward finger and thumb action is often required to withdraw a sample from the front of the bundle in the rack. In addition multiple samples are often withdrawn in error which leads to awkwardness and time wastage in replacing the excess samples. Replacement, in turn, often causes damage to the pamphlets or papers themselves.

Additionally, in many instances, the front wall of the pocket terminates beneath the upper edges of the pamphlets or papers stored therein. As a result the pamphlets or papers tend to curl over the front face and become damaged. At the very least the front surface of the pamphlet or paper is partially obscured.

It is an object of the invention to provide a storage rack and/or a method of forming a storage rack which will overcome at least some of the shortcomings of the prior art as outlined above or which will at least provide the public with a useful choice.

BRIEF SUMMARY OF THE INVENTION

Accordingly, in one aspect, the invention consists in a vertically mountable storage rack for pamphlets, papers and the like, said rack including a rear wall; a front wall spaced from said rear wall, said front wall extending upwardly when said rack is mounted in its position of use; and biasing means, when in use, to bias pamphlets, papers or the like placed in the storage rack when mounted and in use, toward said front wall.

In a further aspect, the invention consists in a method of forming a storage rack for pamphlets, papers and the like from a bendable sheet material, said method comprising the steps of locating side wall members at or adjacent opposite edges of a strip of bendable sheet material such that the planes of the side members lie substantially parallel to the respective edges, and folding said sheet material about said side members to define a rear wall and front wall of said rack.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of storage rack, and method of forming a storage rack, will now be described with reference to the accompanying drawings.

DESCRIPTION OF PREFERRED EMBODIMENT

Figure 2:
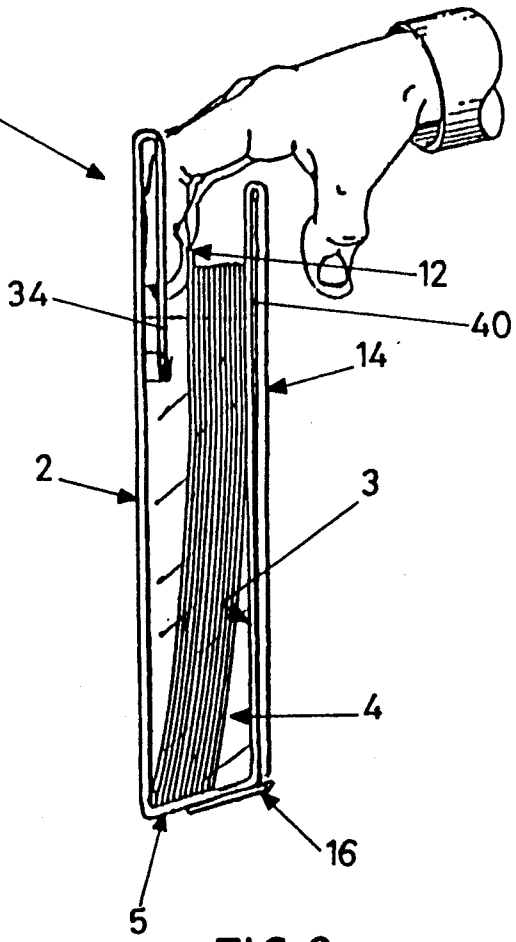
FIG. 2 shows a side elevational view of the storage rack shown in FIG. 1.

Referring to the drawings the invention provides a vertically mountable storage rack 1 having a rear wall 2 and a front wall 3 which are spaced apart to define a pocket 4 in which pamphlets, papers and the like may be stored. The storage rack 1 further includes biasing means, described in greater detail below, to bias the upper-sections of the pamphlets or papers 12 contained in pocket 4 towards the front wall 3 when the rack is in its normal position of use.

Figure 1:
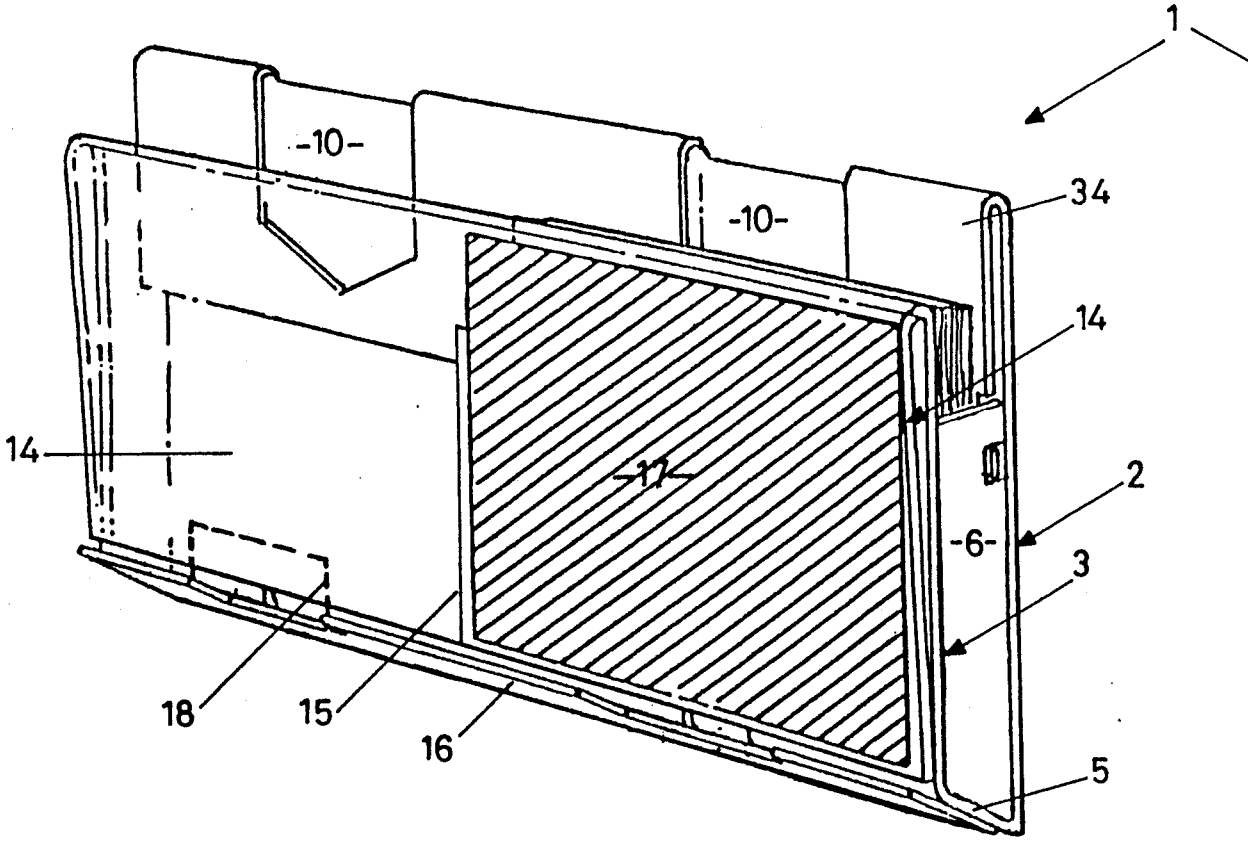
FIG. 1 shows an isometric view of one embodiment of a storage rack according to the invention.

In the preferred embodiment shown in the drawings, the front and rear walls of the storage rack 1 are substantially parallel to one another and are interconnected at their lower ends by a base 5. As can be seen from FIGS. 1 and 2 of the drawings, the base 5 is preferably inclined upwardly from the lower edge of the rear wall 2 to the lower edge of the front wall 3. The base 5, configured in this way, comprises the primary part of the biasing means, the upward slope of the base 5 causing the lower ends of the pamphlets to slide rearwardly thus causing the rearmost pamphlets in the stock to bear against those in front and thus bias the upper sections of the stack of papers or pamphlets against the inner surface of the front wall 3.

In the preferred embodiment as described herein, side walls 6 are provided to further enclose and define the pocket 4.

The preferred embodiment of the invention further includes a finger cavity 10 adjacent the rear wall 2. This cavity 10 facilitates access to the rear most pamphlet 12 within the storage rack 1, particularly when the rack is full and thus permits withdrawal of this pamphlet or paper in a simple action.

The finger cavity 10 may be provided by an aperture formed in the rear wall 2. However, in the embodiment shown the sheet material from which the rear wall 2 is formed is folded inwardly and downwardly to provide flap 34. The apertures 10 are defined in the flap 34. The provision of flap 34 has the further advantage of complimenting the biasing action of the base 5 and directing the upper edges of papers or pamphlets away from the rear wall 3 when the rack is positioned in use.

It will be noted that the lower section of each finger cavity 10 tapers to a point. This is to prevent pamphlets or papers fouling on the lower edges of the finger cavities when being loaded into the rack.

A storage rack according to the invention preferably includes retaining means to retain a sample copy of the pamphlet in a position where it can be conveniently viewed by a person positioned in front of the rack. This retaining means is preferably provided on the outer surface of the front wall 3 and, in the embodiment shown comprises a sleeve defined by a transparent cover sheet 14 which is folded outwardly and downwardly from the upper edge of the front wall 3 and thus not only retains, but also covers, sample copy 17. A retaining plate 16 is preferably fixed to the outer surface of base 5 to project forwardly beneath the lower edge of the cover sheet 14 and thus prevent the sample copy falling from sleeve defined thereby. Alternatively, the lower edge of the cover sheet could be formed into an inwardly aligned lip to serve the same function as retaining plate 16.

An aperture 18 is preferably provided in the plate 16, base 5 and front wall 3 to provide finger access to the inside face of the cover sheet 14 and thus allow a user to adjust the position of the sample copy 17 to provide a neat and tidy appearance. The edges 19 of the apertures 18 are preferably tapered as shown to prevent the lower edges of the pamphlets or papers fouling thereon which, in turn, would prevent the stack of pamphlets sliding rearwardly on base 5 to the position shown in FIG. 2.

It will be appreciated that the sample copy is loaded or replaced by bending the cover sheet 14 away from the front wall 3 and sliding the sample copy 17 into or out from the sleeve created between the cover sheet and front wall. In addition to the function described above, the aperture 18 allows a user to access the inside face of the cover sheet 14 to apply the necessary pressure to bend the cover sheet away from the front wall. Once the sample copy 17 has been inserted, the elasticity of the cover sheet material returns the cover sheet 14 to its position against the front wall.

The storage rack may include one or more laterally adjacent pockets 4. The drawings show a storage rack having two adjacent pockets. To this end, a dividing wall 15 is positioned between the front and rear walls, and base, to define the individual pockets 4. In the preferred embodiment, the dividing wall 15 is substantially the same in both shape and configuration as the side walls 6.

Figure 3:
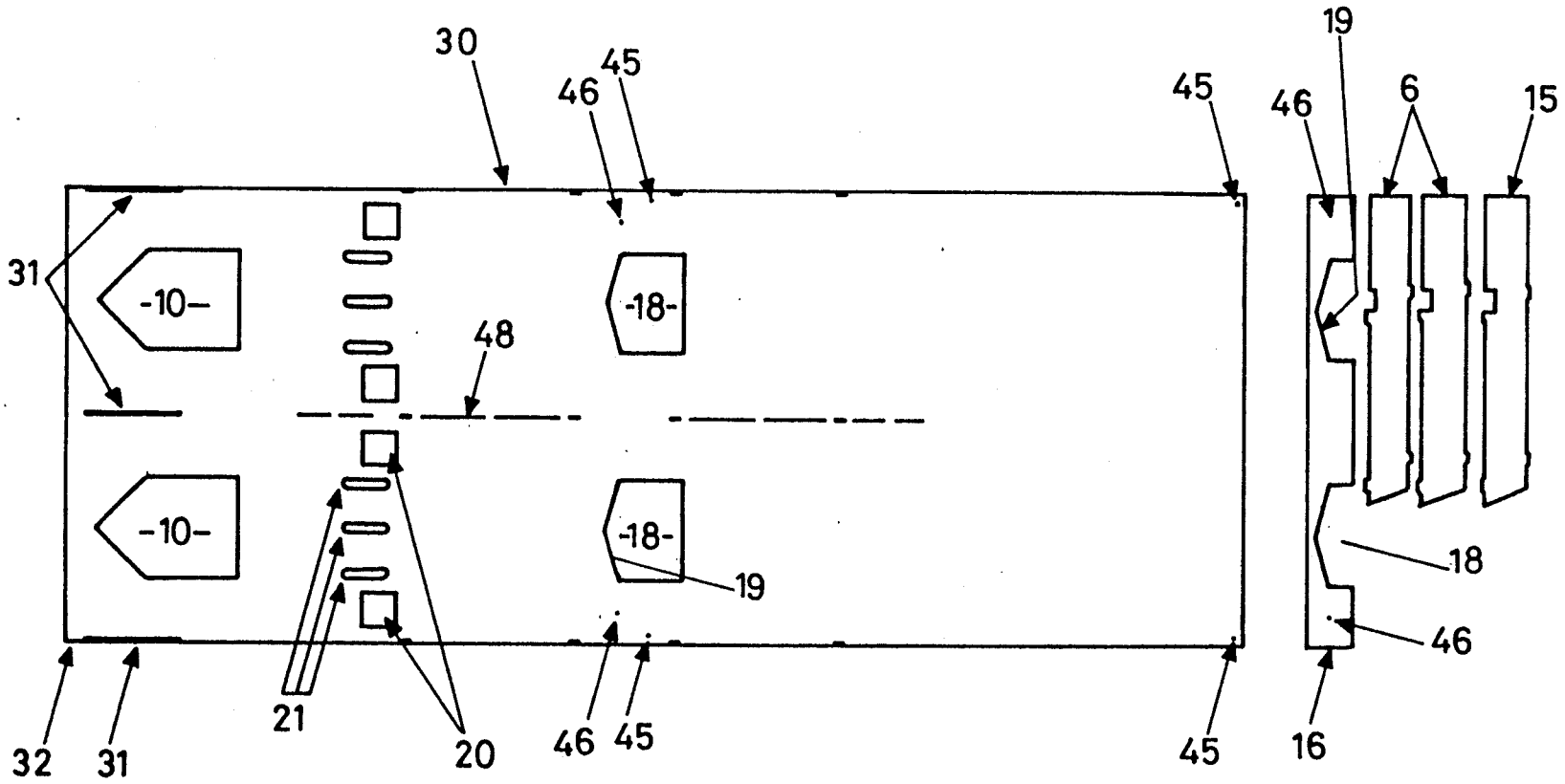
FIG. 3 shows a plan view in a different scale of the components which are combined and formed to provide the storage rack shown in FIG. 1.
Figure 9:
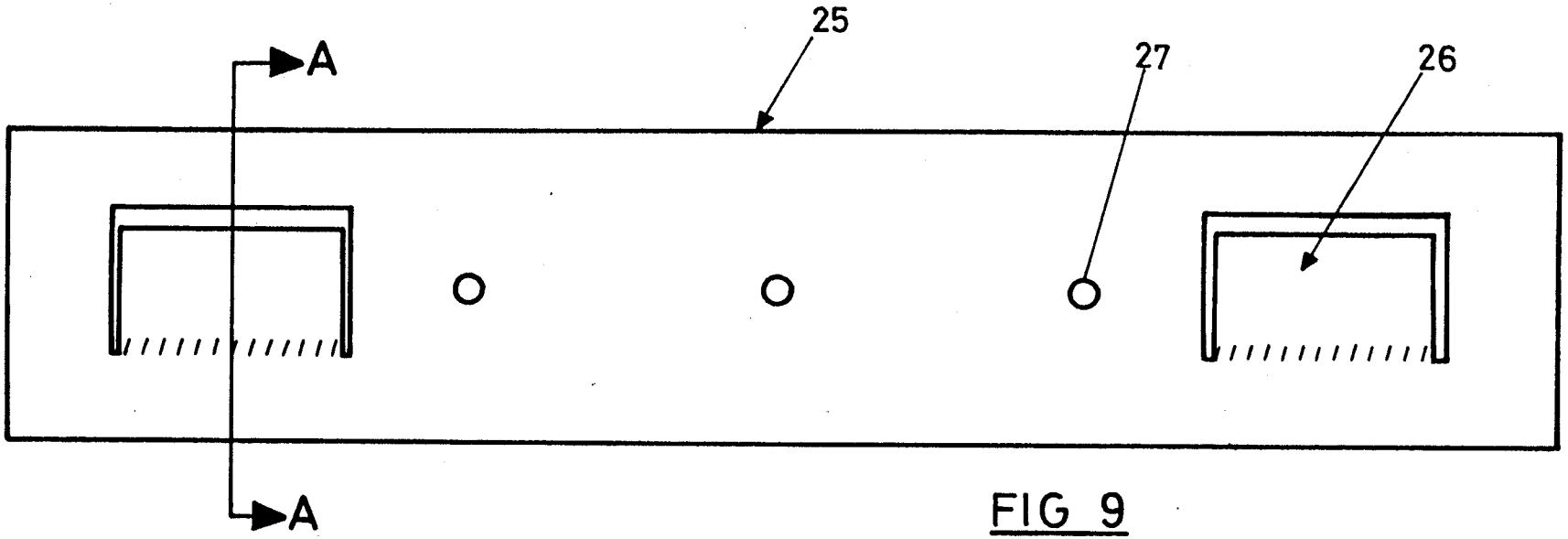
FIG. 9 shows a front elevational view of a support bracket suitable for use in conjunction with a rack embodying the invention.
Figure 10:
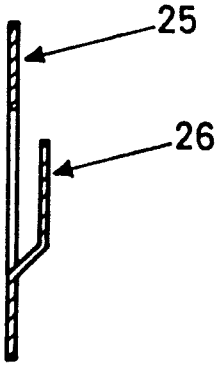
FIG. 10 shows a view along the line A—A in FIG. 9.

Means are preferably provided to allow the rack to be suspended from a vertical support surface such as, for example, the wall of a building. To this end the rear wall 2 of the storage rack 1 may further include apertures 20, as shown on FIG. 3 for engagement with fastening means to support the storage rack 1 on a wall or the like. These fastening means may comprise a separate support bracket 25 as shown in FIGS. 9 and 10. As shown the bracket 25 is shaped and configured so that it may be attached to a surface with screws or similar fasteners (not shown) fixed through apertures 27. The bracket 25 carries connection means 26 for sliding engagement with the apertures 20 in the rear wall 2 of the support rack 1. The rear wall 2 further includes apertures 21 to accommodate the heads of the fasteners used to fix the bracket 25.

It is to be noted that the support bracket 2k shown in FIGS. 9 and 10 is designed for use with an embodiment of the invention having only a single pocket 4 and not the divided twin pocket unit otherwise shown in the drawings. Obviously, suitable versions of the bracket could be constructed for multiple-pocket versions of the rack. Alternatively, or in addition a number of the brackets 25 could be positioned side-by-side to achieve the same result.

The storage rack 1 could, of course, be securely affixed directly to a wall or the like support surface using fixings passed through apertures 20 or 21. However, the advantage of mounting the rack(s) to brackets 25 is that a multiple-rack display can be readily varied by positioning different racks on different mounting brackets. Further, when using the mounting brackets 25 the racks can be easily dismounted for cleaning and for emptying or refilling.

While many suitable sheet materials will present themselves to those skilled in the art from which the storage rack as herein described could be formed, it is preferred that a transparent plastics material such as acrylic, or PERSPEX TM be used.

It should be recognised that a rack embodying the invention could be fabricated from other sheet materials including metals and wood or could be injection moulded.

In use, the storage rack 1 contains papers or pamphlets 12 in pocket 4, the top sections of papers or pamphlets 12 being biased towards the front wall 3 by rearward movement of the bottom sections due to the inclination of base 5. Further biasing of the upper sections may be caused by the flap 34. A person seeking to remove a pamphlet 12 places a finger in the finger cavity 10 and into contact with the rear most paper or pamphlet in the stack. This pamphlet or paper can then be easily withdrawn from the storage rack 1 in a simple action and with a reduced risk of multiple pamphlet withdrawal. Further, the provision of the finger cavity 10 allows easy access to the rear pamphlet 12 even when the storage rack 1 is filled with pamphlets 12 to its capacity.

The invention also consists in a method of forming the storage rack 1 as previously described. FIGS. 3 to 8 of the drawings show sequential stages of formation of a twin pocket embodiment of the storage rack embodying the invention.

As shown the storage rack 1 is preferably formed from a single sheet of bendable sheet material 30, two side wall pieces 6, a central divider 15 and a retaining plate 16. The sheet of material 30 is preformed, preferably by laser cutting, with all the necessary slots and apertures to allow placement and retention of the side walls 6, the intermediate divider 15 and the retaining plate 16 and to define finger apertures 10 and 18 and mounting apertures 20 and 21. Further, the slots 31, tab apertures 36 and 39, locating holes 45 and 46, and the glue slots 48 can also be preformed in the sheet 30 prior to bending.

Figure 4:
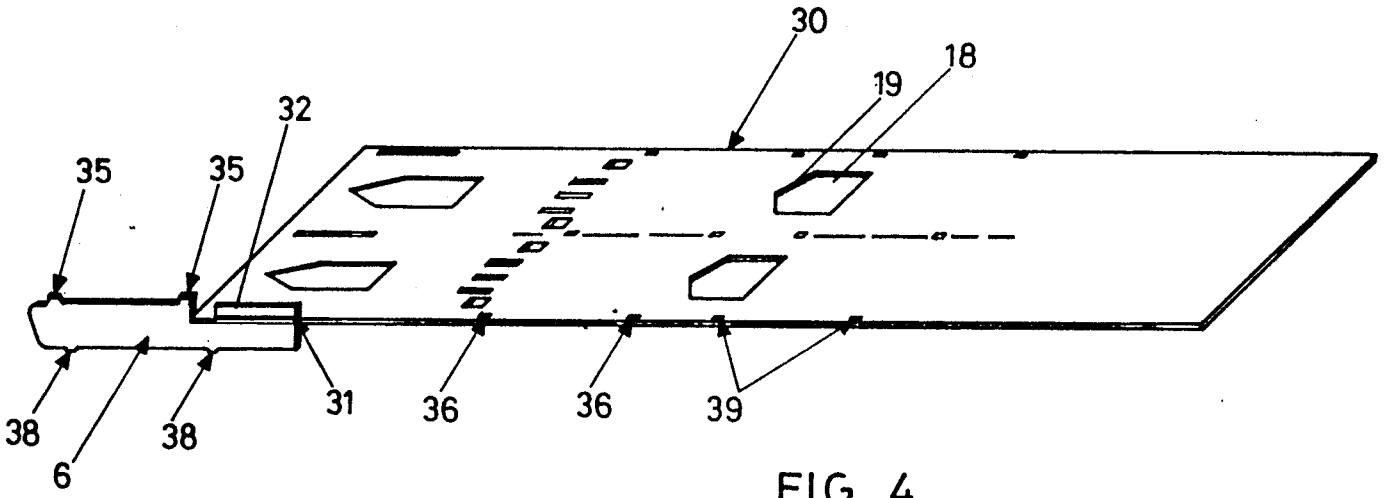
FIGS. 4 to 8 show isometric views of sequential steps in forming the rack shown in FIGS. 1 and 2 from the components shown in FIG. 3.

Essentially, the method comprises positioning the side wall pieces 6 and/or the central divider 15 in spaced, parallel, positions adjacent to one end of the single piece of sheet material 30 as shown in FIG. 4. FIG. 4 shows only a single side wall piece 6, tab 32 of which is located in slot 31 formed in sheet 30 and the side wall piece locked in place. It is to be noted that FIGS. 4 through 8 show the formation of the storage rack with only one side wall 6 provided. The second side wall 6 and the central divider 15 have been omitted from the drawings for clarity but are mounted in slots 31 in an identical manner.

Figure 5:
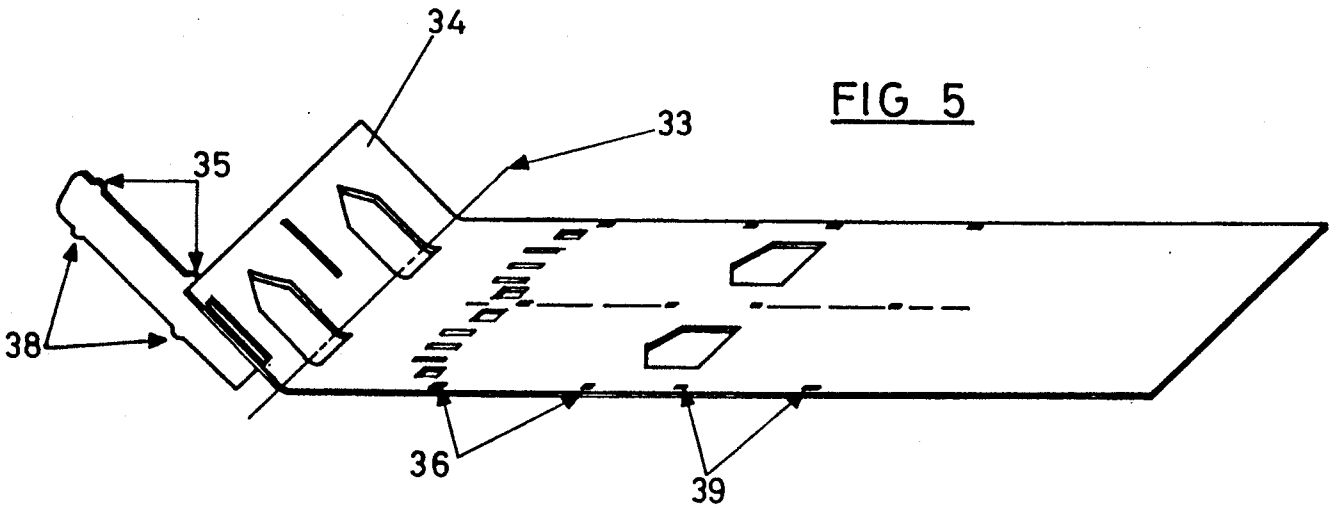
Figure 6:
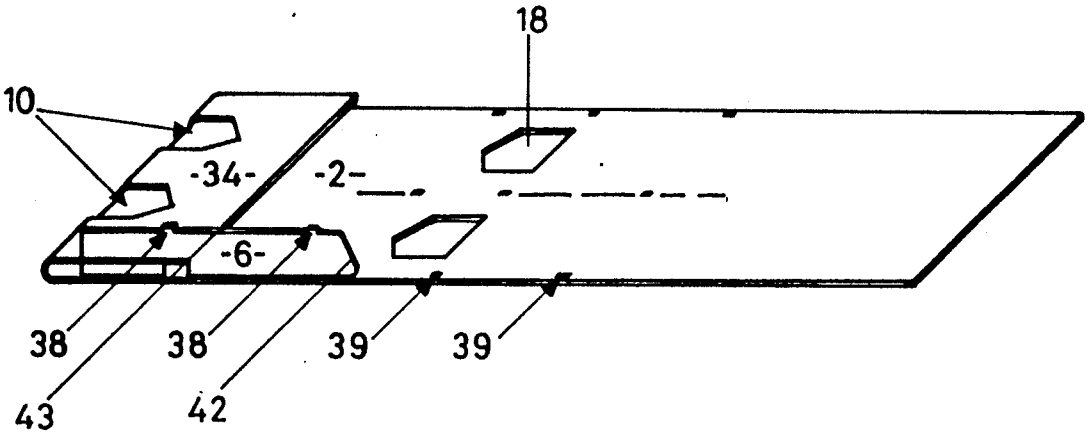

FIGS. 5 and 6 show the next step after the positioning of the side wall 6. The bendable sheet of material is heated along, and bent about, line 33 until the sheet 30 is in the configuration shown in FIG. 6. This creates a fold over in the material to define flap 34 adjacent rear wall 2 in which the finger cavities 10 are provided. This step is completed by locating tabs 35, shown in FIGS. 4 and 5, provided on one edge of side wall 6 in apertures 36, also shown in FIGS. 4 and 5, provided in the sheet material 30.

The next step in the formation process involves further heating and folding of the sheet material 30 but using the side wall(s) 6 and, if applicable, divider 15 as a jig to form the base 5 and the front wall 3. As a first step the sheet 30 is folded about edge 42 on the side wall 6 to define base 5 and thereafter the sheet is further formed about edge 43 to define the front wall 3. In this latter step further tabs 38, shown in FIG. 6, on the side wall 6 are located in further apertures 39, also shown in FIG. 6, in the sheet 30.

Figure 8:
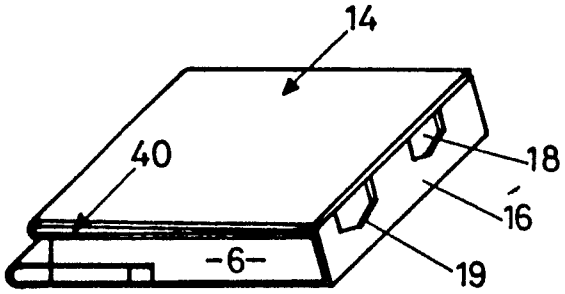
Figure 7:
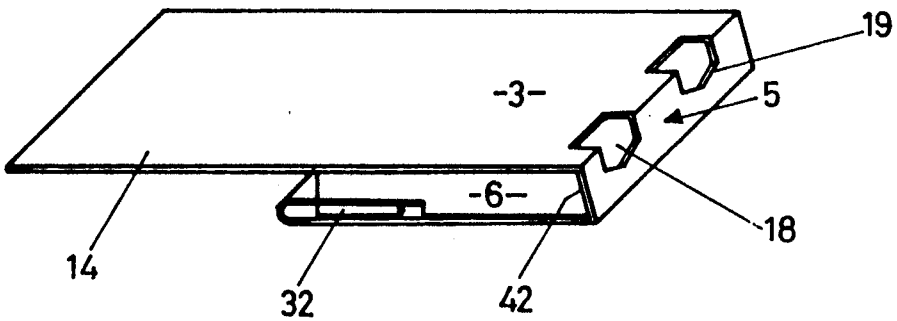

Referring to FIGS. 7 and 8, it can be seen that the portion of the sheet material 30 projecting substantially beyond the free edge of side wall 6 in FIG. 7 is heated and folded back as shown in FIG. 8 to overlie the wall 3 and, in combination with the front wall 3, define the retaining means 14 for a sample pamphlet 17. Further, it can be seen that, in use, the sleeve 40 is accessible from the bottom of the storage rack 1 and, therefore, retaining plate 16 is preferably attached to base 5 to assist in the retention of the sample pamphlet 17 within the sleeve 40 against the forces of gravity.

Locating holes 45 are preferably provided in the sheet material 30 to assist in the alignment and location of the sheet material 30 during formation. For example, referring to FIG. 3, locating holes 45 are provided to ensure that as the sheet 30 is folded over to define retaining means 14, the section of sheet so folded is correctly aligned over the front wall 3. This is achieved by aligning the sets of locating holes 45 using suitable pins (not shown).

Further sets of locating holes 46 may be provided to ensure that the retaining plate 16 is correctly aligned and positioned on the base 5 of the storage rack 1.

Throughout the formation procedure, adhesive may be applied to the edges of the side wall 6 or the sheet material 30 to achieve an interlocking bond therebetween.

Adhesive slots 48 may be provided in the sheet material 30 to allow for the application of adhesive to the dividing wall 15. The adhesive slots 48 allow access for a delivery needle to apply adhesive to the edge of the dividing wall 15.

Preferably, the sheet material comprises a transparent plastics sheet so that the sample pamphlet 17 may be viewed through, and yet be protected by, the retaining means 14.

Thus it can be seen that a storage rack 1 is provided of relatively simple construction and straight forward formation. The invention incorporates many advantages over existing storage racks including the provision of a rack which allow access to the rear most pamphlet 12 for ready withdrawal and allows the pamphlet 12 to be partially withdrawn from the holder with only the use of the finger tips behind the pamphlet. This decreases the likelihood of multiple pamphlet withdrawal when compared with prior art racks which require the initial withdrawal of the pamphlet by both the fingers and thumb. This is especially applicable when comparing the present invention with those in which the front most pamphlet is withdrawn.

The preferred embodiment of the invention as described herein also encloses the pamphlets 12 substantially completely so that the top edges of the pamphlets 12 are supported and do not overhang the front wall 3. This provides a tidier arrangement of pamplets 12 and decreases the extent to which the pamphlets deteriorate while positioned in the rack.

A still further advantage is that a sample pamphlet may be retained in sleeve 40 adjacent the front face where it is both protected and visible to give a clear, high quality, presentation of the contents of the rack whether full or empty and indicates to the stockist what pamphlet is required to restock the rack.

What is claimed is:

1. A vertically mounted storage rack for sheet-like articles such as pamphlets, papers and the like, said rack including a rear wall; a front wall spaced from said rear wall and generally parallel to said rear wall, said front wall extending generally vertically, said rack further including an open top and a base interconnecting lower ends of the front and rear walls, and wherein said base is inclined upwardly from a lower edge of said rear wall to a lower edge of said front wall, and a stack of said articles placed in the storage rack on said base with upper edges of the articles biased towards the front wall of said rack and with a rearmost one of said articles spaced from the rear wall for withdrawal wherein the rack includes a flap extending downwardly and spaced from an upper edge of said rear wall and partially overlying said rear wall to a level below the top of the front wall and a finger cavity formed in the flap to facilitate access to a rearmost article in the stack.

2. A vertically mounted storage rack for sheet-like articles such as pamphlets, papers and the like, said rack including a rear wall; a front wall spaced from said rear wall and generally parallel to said rear wall, said front wall extending generally vertically, said rack further including an open top and a base interconnecting lower ends of the front and rear walls, and wherein said base is inclined upwardly from a lower edge of said rear wall to a lower edge of said front wall, and a stack of said articles placed in the storage rack on said base with upper edges of the articles biased towards the front wall of said rack and with a rearmost one of said articles spaced from the rear wall for withdrawal wherein said front wall of said rack projects above the top of said stack.

3. A vertically mountable storage rack for sheet-like articles such as pamphlets, papers and the like, said rack including a rear wall; a front wall spaced from said rear wall and generally parallel to said rear wall, said rack further including a base interconnecting lower ends of the front and rear walls, and wherein said base is inclined upwardly from a lower edge of said rear wall to a lower edge of said front wall, a flap extending downwardly and spaced from an upper edge of said rear wall and partially overlying said rear wall to a level below the top of the front wall and a finger cavity formed in the flap to facilitate access to a rearmost article in the rack.

4. A storage rack as claimed in claim 3 wherein said rack further includes retaining means constructed and arranged to retain a sample article in contact with the outer surface of said front wall.

5. A storage rack as claimed in claim 4 wherein said retaining means further defines a transparent covering surface for the sample article and said retaining means dimensioned to, in use, retain a sample article being a full sized representation of the contents of the rack.

6. A rack as claimed in claim 3 wherein said rack includes a plurality of dividers to divide said rack into a number of laterally adjacent pockets.

7. A rack as claimed in claim 3 wherein the finger cavity has a V-shaped lower edge.

* * * * *